US012630987B2

(12) United States Patent
Tanaka et al.

(10) Patent No.: US 12,630,987 B2
(45) Date of Patent: May 19, 2026

(54) REUSABLE VEHICLE OCCUPANT PROTECTION SYSTEM HAVING REUSABLE IMPACT ATTENUATOR MEMBERS

(71) Applicant: Toyota Motor Engineering & Manufacturing North America, Inc, Plano, TX (US)

(72) Inventors: Masato Tanaka, Ann Arbor, MI (US); Yuyang Song, Ann Arbor, MI (US); Shinnosuke Shimokawa, Ann Arbor, MI (US)

(73) Assignee: TOYOTA MOTOR ENGINEERING & MANUFACTURING NORTH INC, Plano, TX (US)

( * ) Notice: Subject to any disclaimer, the term of this patent is extended or adjusted under 35 U.S.C. 154(b) by 824 days.

(21) Appl. No.: 18/049,755

(22) Filed: Oct. 26, 2022

(65) Prior Publication Data

US 2024/0141604 A1 May 2, 2024

(51) Int. Cl.
*E01F 15/14* (2006.01)

(52) U.S. Cl.
CPC ..... *E01F 15/146* (2013.01)

(58) Field of Classification Search
CPC . B60R 19/20; B60R 2021/0407; B60R 21/04; E01F 15/146
See application file for complete search history.

(56) References Cited

U.S. PATENT DOCUMENTS

2016/0053843 A1* 2/2016 Subhash ..... F16F 13/08 267/140.11
2018/0281714 A1* 10/2018 Gandhi ..... B60R 19/18

OTHER PUBLICATIONS amazon.com,"Stress Balls for Kids Fidget Toys—8 Pack Squishy Stress Ball Nedoh Needohball Stress Relief Ball for Adults Squeeze Ball Sensory Ball Rainbow Stress Ball Ideal for Autism, Anxiety & More", retrieved on Jul. 10, 2022, <amazon.com/Stress-Balls-Kids-Fidget-Toys/dp/B098SP4MF3/ref=sr_1_4_sspa?keywords=water+bead+str+balls&qid=1657394866&sr=8-4spons&psc=1&spLa=ZW5jcnlwdGVkUXVhbGlmaWVyPUEzNDBCNjIDVFczROVOJmVuY3J5cHRIZEIkPUEwMzlyOTI5MIhITFdHMEINSE1POCZIbmNyeXB0ZWRBZEIKPUEwODI0MDcwMU9FVFRWWFRHT0NSMyZ3aWRnZXROYW1lPXNwX2F0ZiZhY3Rpb249Y2xpY2tSZWRpcmVjdCZkb05vdExvZ0NsaWNrPXRydWU=)>, 4 pages.
Amazon.com, SET4kids—Stress Ball 2 Pack. One"Happy Face"—Yellow and One Marbleized-Assorted Colors. E-Book Included, retrieved on Jul. 10, 2022, <amazon.com/SET4kids-Marbleized-Assorted-Book-Included/dp/B07QT8PGDB/ref=sr_1_9?keywords=balloons+for+stress+balls&qid=1656428607&sr-8-9>, 3 pages.
Anonymous, "Are Isoflex Stress Balls Toxic In Any Way?", retrieved on Jul. 10, 2022, <loveperfectchange.com/are-isoflex-stress-balls-toxic-in-any-way/#:~:text=Not%20all%20stress%20balls%20are%20made%20the%20same>, 4 pages.

* cited by examiner

*Primary Examiner* — Jason D Shanske
*Assistant Examiner* — Scott Lawrence Strickler
(74) *Attorney, Agent, or Firm* — Jordan IP Law, LLC

(57) ABSTRACT

A reusable vehicle occupant protection system that includes a reusable housing member and one or more reusable impact attenuator members, disposed in a cavity of the reusable housing member. The reusable housing member has at least one moveable wall having one or more openings. The one or more reusable impact attenuator members are moveable from a storage operating state to a deployed operating state in response to receipt of a compressive force by the at least one moveable wall. In the deployed state, at least a portion of the one or more reusable impact attenuator members are extruded through the one or more openings to form an array of impact bubbles which cushions a vehicle occupant against an impact force to the vehicle.

20 Claims, 7 Drawing Sheets

REUSABLE VEHICLE OCCUPANT PROTECTION SYSTEM HAVING REUSABLE IMPACT ATTENUATOR MEMBERS

TECHNICAL FIELD

One or more embodiments relate generally to a reusable vehicle occupant protection system operable to cushion a vehicle occupant against an impact force to the vehicle.

BACKGROUND

Contemporary impact attenuators, such as, for example, vehicle airbags, in vehicle occupant protection systems generally include an inflatable flexible fabric bag and an inflation module having a gas source to inflate the flexible fabric bag during deployment. Such vehicle airbags are deployed through a pyrotechnic process that is designed for single use. Even should they be designed for multi-use, it is difficult to store a previously-deployed flexible fabric bag in a compact space for reuse.

BRIEF SUMMARY

A vehicle occupant protection system that does not require or use internal air or liquid input for deployment. Instead, the vehicle occupant protection system utilizes one or more reusable impact attenuator members composed of a chemically inert, flowable, incompressible material or nearly incompressible material that dampens the effects of an impact force to vehicle occupants in a vehicle collision. The one or more reusable impact attenuator members has a structural and material configuration that that facilitates reuse of the vehicle occupant protection system over many operational cycles.

The one or more reusable impact attenuator members are moveable from a storage operating state to a deployed operating state in response to receipt of a compressive force by the at least one moveable wall of a reusable housing member. In the deployed state, at least a portion of the one or more reusable impact attenuator members are extruded through the one or more openings to form an array of impact bubbles which cushions a vehicle occupant against an impact force to the vehicle In accordance with one or more embodiments, a reusable vehicle occupant protection system comprises one or more of the following: a reusable housing member having at least one moveable wall having one or more openings; and one or more reusable impact attenuator members, disposed in a cavity of the reusable housing member, that are moveable from a storage operating state to a deployed operating state in response to receipt of a compressive force by the at least one moveable wall that extrudes at least a portion of the one or more reusable impact attenuator members through the one or more openings to form an array of impact bubbles which cushions a vehicle occupant against an impact force to the vehicle.

In accordance with the reusable vehicle occupant protection system, the impact bubbles are caused to retract through the one or more openings in response to release of the compressive force by the at least one moveable wall.

In accordance with the reusable vehicle occupant protection system, in the storage operating state the one or more reusable impact attenuator members have a first structural configuration.

In accordance with the reusable vehicle occupant protection system, in the deployed state the one or more reusable impact attenuator members have a second structural configuration that is different than the first structural configuration.

In accordance with the reusable vehicle occupant protection system, the one or more reusable impact attenuator members return to the first structural configuration in response to release of the compressive force by the at least one moveable wall.

In accordance with the reusable vehicle occupant protection system, the one or more openings have the same geometric cross-section.

In accordance with the reusable vehicle occupant protection system, the one or more openings have different geometric cross-sections.

In accordance with the reusable vehicle occupant protection system, the one or more reusable impact attenuator members comprises a reusable protective outer covering that encloses a reusable protective filler material.

In accordance with one or more embodiments, a reusable vehicle occupant protection system comprises one or more of the following: one or more reusable impact attenuator members; and a reusable housing member having a plurality of walls defining a cavity that receives the one or more reusable impact attenuator members, at least one wall in the plurality of the walls being a moveable wall having one or more openings, the at least one wall being moveable in response to receipt of an impact force to the vehicle, from an initial, inactive position to an active position which applies a compressive force to the one or more impact attenuator members, such compressive force causing extrusion of at least a portion of the one or more reusable impact attenuator members through the one or more openings to form an array of impact bubbles which cushions a vehicle occupant against the impact force.

In accordance with the reusable vehicle occupant protection system, the impact bubbles are caused to retract through the one or more openings in response to release of the compressive force by the at least one moveable wall.

In accordance with the reusable vehicle occupant protection system, in the storage operating state the one or more reusable impact attenuator members have a first structural configuration.

In accordance with the reusable vehicle occupant protection system, in the deployed state the one or more reusable impact attenuator members have a second structural configuration that is different than the first structural configuration.

In accordance with the reusable vehicle occupant protection system, the one or more reusable impact attenuator members return to the first structural configuration in response to release of the compressive force by the at least one moveable wall.

In accordance with the reusable vehicle occupant protection system, the one or more openings have the same geometric cross-section.

In accordance with the reusable vehicle occupant protection system, the one or more openings have different geometric cross-sections.

In accordance with one or more embodiments, a method of manufacturing a reusable vehicle occupant protection system comprises one or more of the following: forming a reusable housing member having at least one moveable wall having one or more openings; and positioning one or more reusable impact attenuator members in a cavity of the reusable housing member, the one or more reusable impact attenuator members being moveable from a storage operating state to a deployed operating state in response to receipt of a compressive force by the at least one moveable wall that extrudes at least a portion of the one or more reusable impact attenuator members through the one or more openings to form an array of impact bubbles which cushions a vehicle occupant against an impact force to the vehicle.

In accordance with the method, the impact bubbles are caused to retract through the one or more openings in response to release of the compressive force by the at least one moveable wall.

In accordance with the method, in the storage operating state, the one or more reusable impact attenuator members have a first structural configuration.

In accordance with the method, in the deployed state, the one or more reusable impact attenuator members have a second structural configuration that is different than the first structural configuration.

In accordance with the method, the one or more reusable impact attenuator members return to the first structural configuration in response to release of the compressive force by the at least one moveable wall.

In accordance with the method, the one or more openings have the same geometric cross-section.

In accordance with the method, the one or more openings have different geometric cross-sections.

In accordance with one or more embodiments, a vehicle occupant protection system comprises one or more of the following: a housing member having at least one moveable wall having one or more openings; and one or more impact attenuator members, disposed in a cavity of the housing member, that are moveable from a storage operating state to a deployed operating state in response to receipt of a compressive force by the at least one moveable wall that extrudes at least a portion of the one or more impact attenuator members through the one or more openings to form an array of impact bubbles which cushions a vehicle occupant against an impact force to the vehicle.

In accordance with the vehicle occupant protection system, the impact bubbles are caused to retract through the one or more openings in response to release of the compressive force by the at least one moveable wall.

In accordance with the vehicle occupant protection system, in the storage operating state the one or more impact attenuator members have a first structural configuration.

In accordance with the vehicle occupant protection system, in the deployed state the one or more impact attenuator members have a second structural configuration that is different than the first structural configuration.

In accordance with the vehicle occupant protection system, the one or more impact attenuator members return to the first structural configuration in response to release of the compressive force by the at least one moveable wall.

In accordance with the vehicle occupant protection system, the one or more openings have the same geometric cross-section.

In accordance with the vehicle occupant protection system, the one or more openings have different geometric cross-sections.

In accordance with the vehicle occupant protection system, the one or more impact attenuator members comprises a protective outer covering that encloses a reusable protective filler material.

In accordance with one or more embodiments, a vehicle occupant protection system comprises one or more of the following: one or more impact attenuator members; and a housing member having a plurality of walls defining a cavity that receives the one or more impact attenuator members, at least one wall in the plurality of the walls being a moveable wall having one or more openings, the at least one wall being moveable in response to receipt of an impact force to the vehicle, from an initial, inactive position to an active position which applies a compressive force to the one or more impact attenuator members, such compressive force causing extrusion of at least a portion of the one or more impact attenuator members through the one or more openings to form an array of impact bubbles which cushions a vehicle occupant against the impact force.

In accordance with the vehicle occupant protection system, the impact bubbles are caused to retract through the one or more openings in response to release of the compressive force by the at least one moveable wall.

In accordance with the vehicle occupant protection system, in the storage operating state the one or more impact attenuator members have a first structural configuration.

In accordance with the vehicle occupant protection system, in the deployed state the one or more impact attenuator members have a second structural configuration that is different than the first structural configuration.

In accordance with the vehicle occupant protection system, the one or more impact attenuator members return to the first structural configuration in response to release of the compressive force by the at least one moveable wall.

In accordance with the vehicle occupant protection system, the one or more openings have the same geometric cross-section.

In accordance with the vehicle occupant protection system, the one or more openings have different geometric cross-sections.

In accordance with one or more embodiments, a method of manufacturing a vehicle occupant protection system comprises one or more of the following: forming a housing member having at least one moveable wall having one or more openings; and positioning one or more impact attenuator members in a cavity of the reusable housing member, the one or more impact attenuator members being moveable from a storage operating state to a deployed operating state in response to receipt of a compressive force by the at least one moveable wall that extrudes at least a portion of the one or more impact attenuator members through the one or more openings to form an array of impact bubbles which cushions a vehicle occupant against an impact force to the vehicle.

In accordance with the method, the impact bubbles are caused to retract through the one or more openings in response to release of the compressive force by the at least one moveable wall.

In accordance with the method, in the storage operating state, the one or more impact attenuator members have a first structural configuration.

In accordance with the method, in the deployed state, the one or more impact attenuator members have a second structural configuration that is different than the first structural configuration.

In accordance with the method, the one or more impact attenuator members return to the first structural configuration in response to release of the compressive force by the at least one moveable wall.

In accordance with the method, the one or more openings have the same geometric cross-section.

In accordance with the method, the one or more openings have different geometric cross-sections.

In accordance with one or more embodiments, a reusable vehicle occupant protection system comprises one or more of the following: one or more reusable impact attenuator members that are moveable from a storage operating state to a deployed operating state in response to receipt of a compressive force that causes extrusion of at least a portion of the one or more reusable impact attenuator members through one or more openings to form an array of impact bubbles which cushions a vehicle occupant against an impact force to the vehicle.

In accordance with the reusable vehicle occupant protection system, the impact bubbles are caused to retract through the one or more openings in response to release of the compressive force by the at least one moveable wall.

In accordance with the reusable vehicle occupant protection system, in the storage operating state the one or more reusable impact attenuator members have a first structural configuration.

In accordance with the reusable vehicle occupant protection system, in the deployed state the one or more reusable impact attenuator members have a second structural configuration that is different than the first structural configuration.

In accordance with the reusable vehicle occupant protection system, the one or more reusable impact attenuator members return to the first structural configuration in response to release of the compressive force by the at least one moveable wall.

In accordance with the reusable vehicle occupant protection system, the one or more reusable impact attenuator members comprises a reusable protective outer covering that encloses a reusable protective filler material.

In accordance with one or more embodiments, a reusable vehicle occupant protection system comprises one or more of the following: a reusable housing member having a plurality of walls that includes at least one wall being a moveable wall having one or more openings, the at least one wall being moveable in response to receipt of an impact force to the vehicle, from an initial, inactive position to an active position which applies a compressive force to one or more impact attenuator members that causes extrusion of at least a portion of the one or more reusable impact attenuator members through the one or more openings to form an array of impact bubbles which cushions a vehicle occupant against the impact force.

In accordance with the reusable vehicle occupant protection system, the one or more openings have the same geometric cross-section.

In accordance with the reusable vehicle occupant protection system, the one or more openings have different geometric cross-sections.

In accordance with one or more embodiments, a method of manufacturing a vehicle occupant protection system comprises one or more of the following: forming: positioning one or more reusable impact attenuator members in a cavity for movement from a storage operating state to a deployed operating state in response to receipt of a compressive force that causes extrusion of at least a portion of the one or more reusable impact attenuator members through one or more openings to form an array of impact bubbles which cushions a vehicle occupant against an impact force to the vehicle.

In accordance with the method, the impact bubbles are caused to retract through the one or more openings in response to release of the compressive force by the at least one moveable wall.

In accordance with the method, in the storage operating state, the one or more impact attenuator members have a first structural configuration.

In accordance with the method, in the deployed state, the one or more impact attenuator members have a second structural configuration that is different than the first structural configuration.

In accordance with the method, the one or more impact attenuator members return to the first structural configuration in response to release of the compressive force by the at least one moveable wall.

BRIEF DESCRIPTION OF THE SEVERAL VIEWS OF THE DRAWINGS

The various advantages of the exemplary embodiments will become apparent to one skilled in the art by reading the following specification and appended claims, and by referencing the following drawings, in which:

DETAILED DESCRIPTION

Turning to the figures, which illustrates an example reusable vehicle occupant protection system 10, in accordance with one or more embodiments. In accordance with one or more embodiments, a "vehicle" may be in reference to any form of motorized transport. In accordance with one or more embodiments, the vehicle may comprise an automobile. Embodiments, however, are not limited thereto, and thus, this disclosure contemplates the vehicle comprising a watercraft, an aircraft, a spacecraft, or any other form of transport vehicle that falls within the spirit and scope of the principles of this disclosure.

Figure 1:
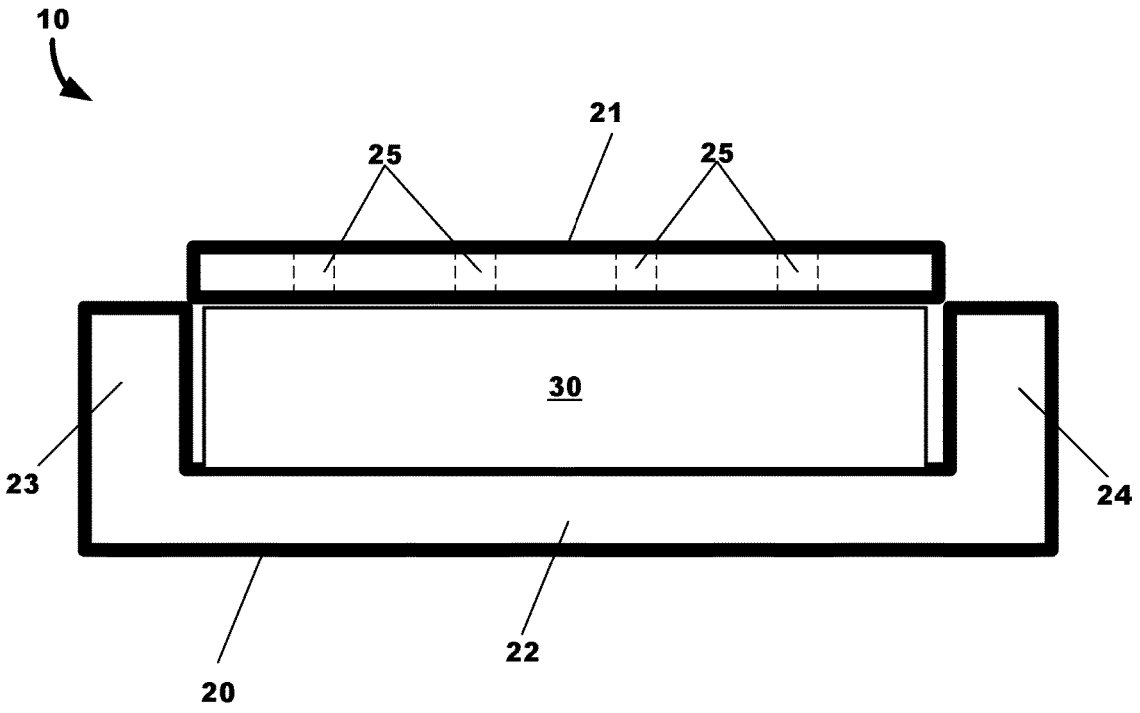
FIG. 1 illustrates a side sectional view of an example reusable vehicle occupant protection system in an inactive operating state, in accordance with one or more embodiments set forth, shown, and described herein.

The example vehicle occupant protection system 10 may comprise one or more operational elements, some of which may form in whole or in part a component in a cabin of the vehicle. Some of the possible operational elements of the vehicle occupant protection system 10 are illustrated in FIG. 1 and will now be described herein. It will be understood that it is not necessary for the vehicle occupant protection system 10 to have all the elements illustrated in the drawing figures and/or described herein. The vehicle occupant protection system 10 may have any combination of the various elements illustrated in FIG. 1. Moreover, the vehicle occupant protection system 10 may have additional elements to those illustrated in FIG. 1.

As illustrated in FIG. 1, the example vehicle occupant protection system 10 comprises a reusable housing member 20 and one or more reusable impact attenuator members 30.

Reusable Housing Member

Figure 3:
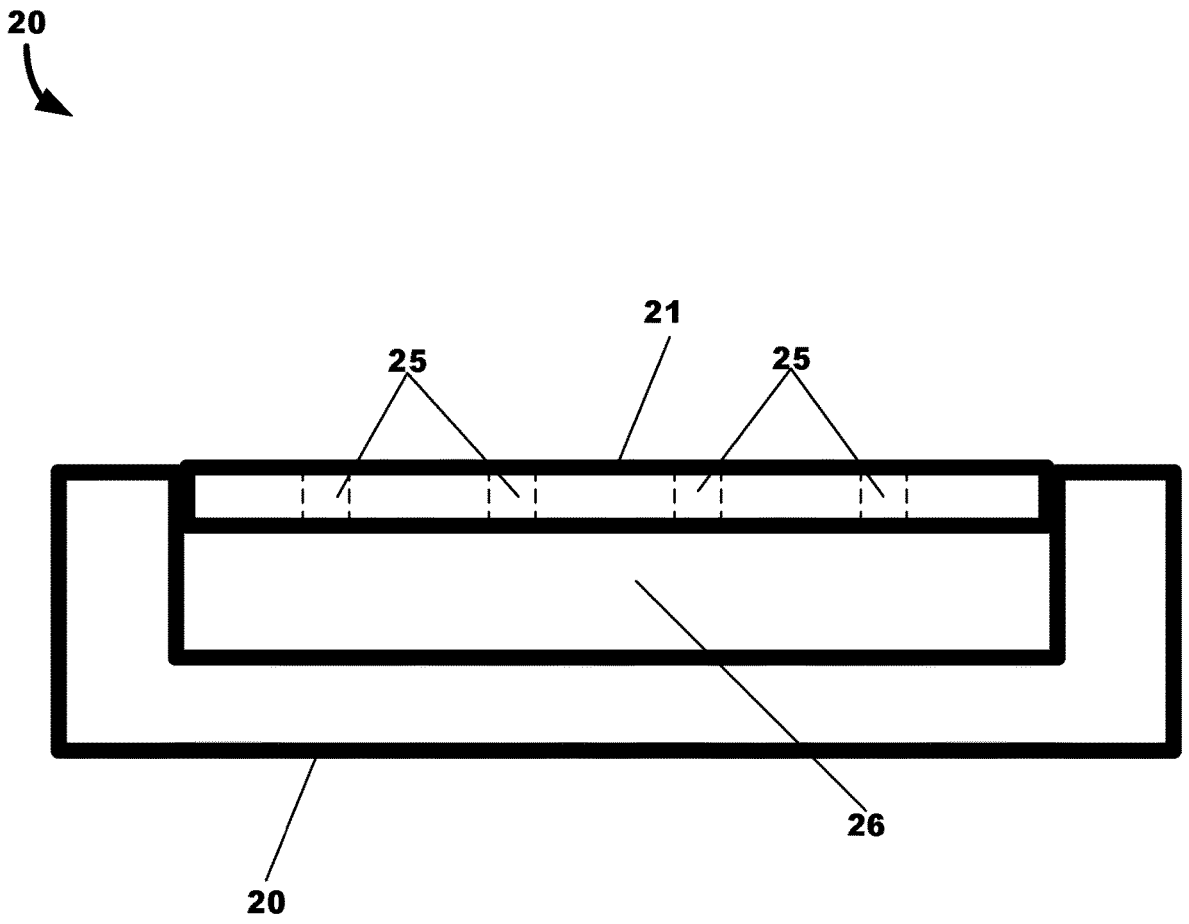
FIG. 3 illustrates a side sectional view of an example reusable housing member of the example reusable vehicle occupant protection system of FIG. 1.

As illustrated in FIG. 3, the reusable housing member 20 comprises a top wall 21, a bottom wall 22, and a pair of sidewalls 23, 24 that define a cavity 26 sized to receive the one or more reusable impact attenuator members 30 therein. In accordance with one or more embodiments set forth, shown, and described herein, the reusable housing member 20 is composed of a durable material exhibiting high impact resistance. Such a material may comprise a 3D printable material that lends itself for reuse over many operational cycles. Such a 3D printable material may comprise, for example, a polymer material. Embodiments, however, are not limited thereto, and thus, this disclosure contemplates the reusable housing member 20 being composed of any suitable material that falls within the spirit and scope of the principles of this disclosure. In particular, the reusable housing member 20 may be composed of any material that optimizes the impact performance of the example vehicle occupant protection system 10.

In accordance with one or more embodiments set forth, shown, and described herein, at least one of the walls 21, 22, 23, 24 comprises a wall that is moveable relative to the other walls. In the illustrated example embodiment of FIGS. 1 and 2, the moveable wall comprises the top wall 21. Embodiments, however, are not limited thereto, and thus, this disclosure contemplates the moveable wall comprising any suitable wall that falls within the spirit and scope of the principles of this disclosure.

Figure 9:
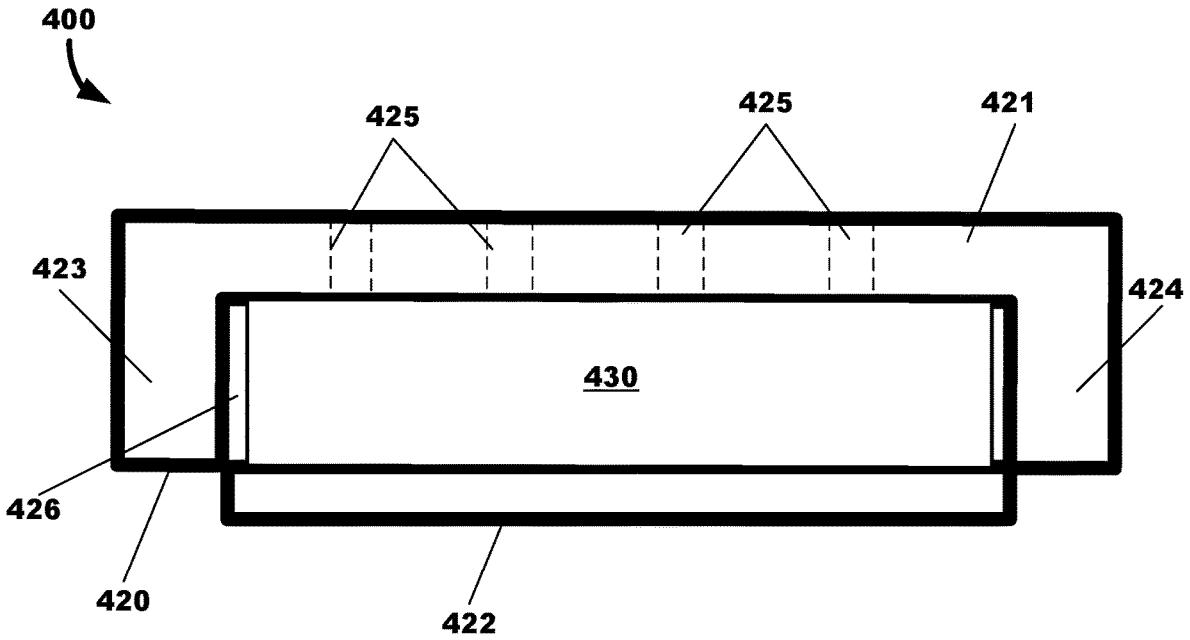
FIG. 9 illustrates a side sectional view of an example reusable vehicle occupant protection system in an inactive operating state, in accordance with one or more embodiments set forth, shown, and described herein.
Figure 10:
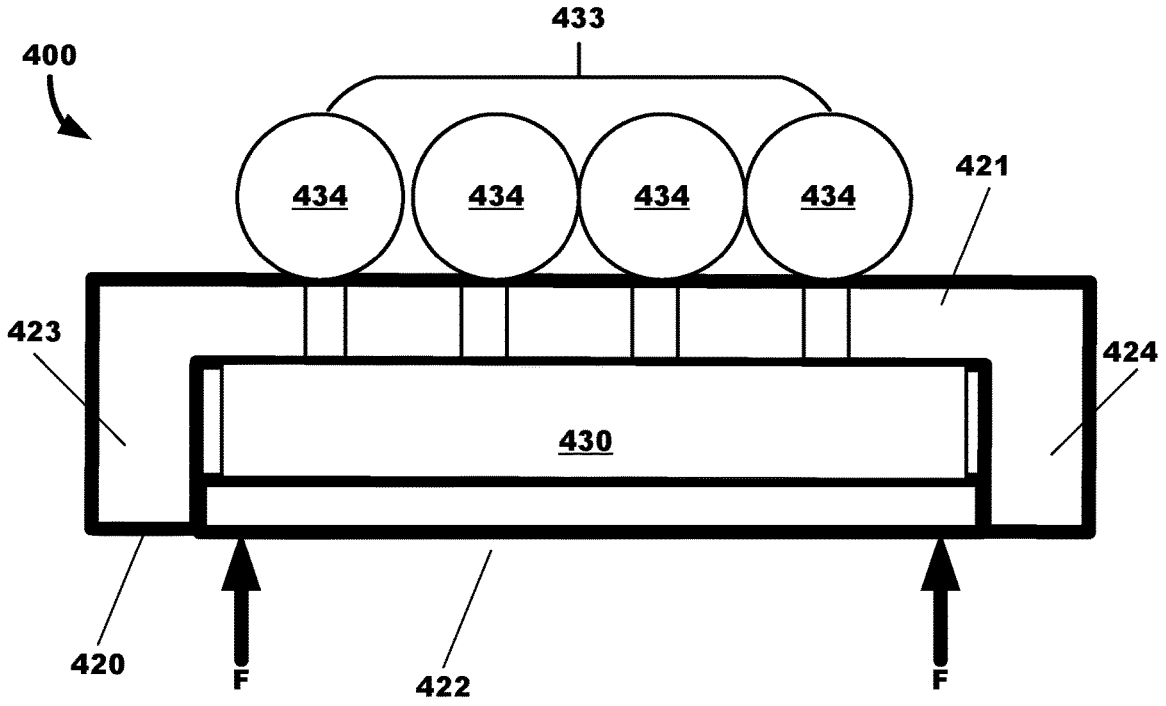
FIG. 10 illustrates a side sectional view of the example reusable vehicle occupant protection system of FIG. 8 in a deployed operating state.

For example, in the illustrated example embodiment of FIGS. 9 and 10, an example vehicle occupant protection system 400 comprises a reusable housing member 420 and one or more reusable impact attenuator members 430. The reusable housing member 420 comprises a top wall 421, a bottom wall 422, and a pair of sidewalls 423, 424 that define a cavity 426 sized to receive one or more reusable impact attenuator members 430 therein. In the illustrated embodiment, the moveable wall comprises the bottom wall 422.

Moreover, in the illustrated example embodiment, one wall is moveable relative to the other walls. Embodiments, however, are not limited thereto, and thus, this disclosure contemplates two or more walls being moveable wall in a manner that falls within the spirit and scope of the principles of this disclosure. In particular, the reusable housing member 20 may have any number of moveable walls that optimizes the impact performance of the example vehicle occupant protection system 10, 400.

The moveable wall has one or more openings 25, 125, 225, 325. In accordance with one or more embodiments set forth, shown, and described herein, the one or more openings 25, 125, 225, 325 have the same geometric cross-section. Embodiments, however, are not limited thereto, and thus, this disclosure contemplates the one or more openings 25, 125, 225, 325 having alternating, varying, or different geometric cross-sections in a manner that falls within the spirit and scope of the principles of this disclosure. For example, the one or more openings 25, 125, 225, 325 may be spatially arranged in a symmetrical configuration in a manner which optimizes the impact performance of the example vehicle occupant protection system 10, 400. Alternatively, the one or more openings 25, 125, 225, 325 may be spatially arranged in an asymmetrical configuration in a manner which optimizes the impact performance of the example vehicle occupant protection system 10, 400.

Figure 5:
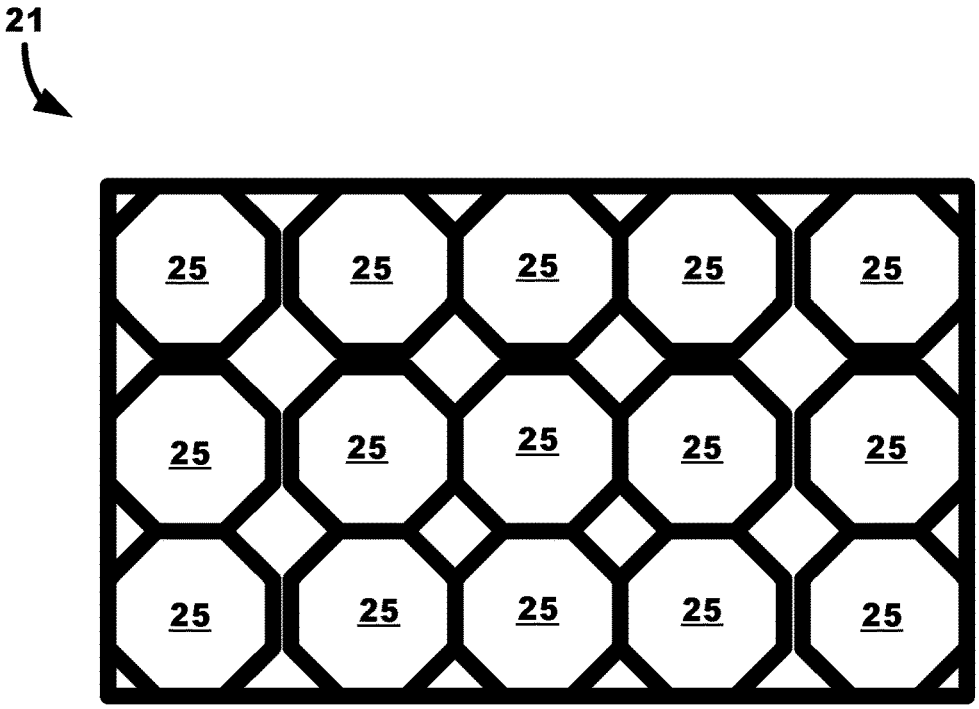
FIGS. 5 through 8 respectively illustrate a top view of an example moveable top wall of an example reusable housing member, in accordance with one or more embodiments set forth, shown, and described herein.
Figure 6:
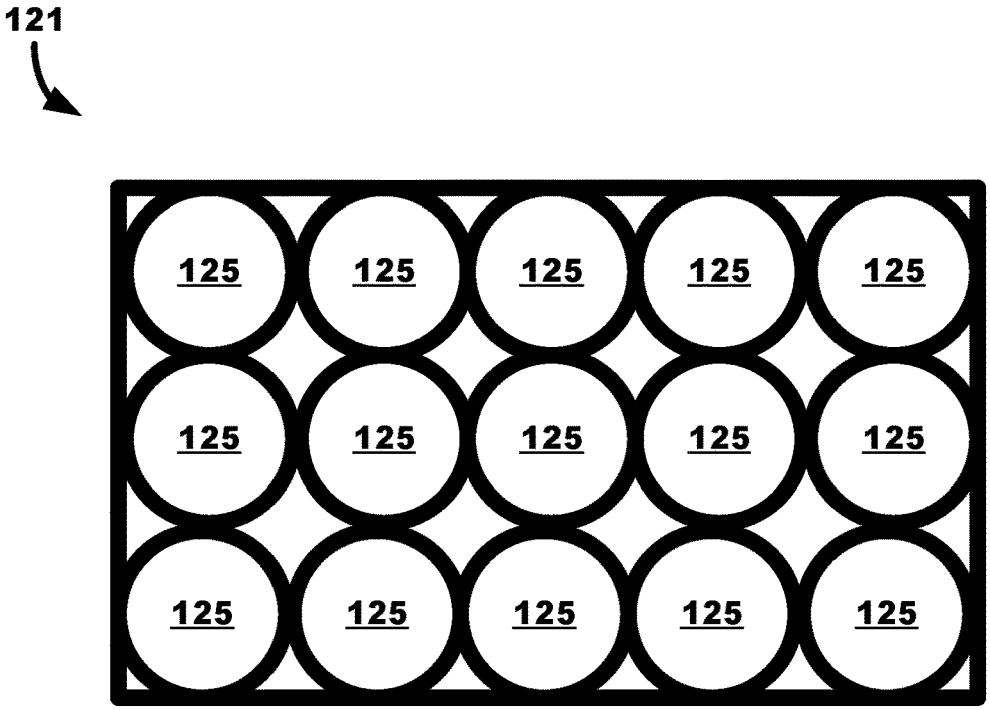
Figure 7:
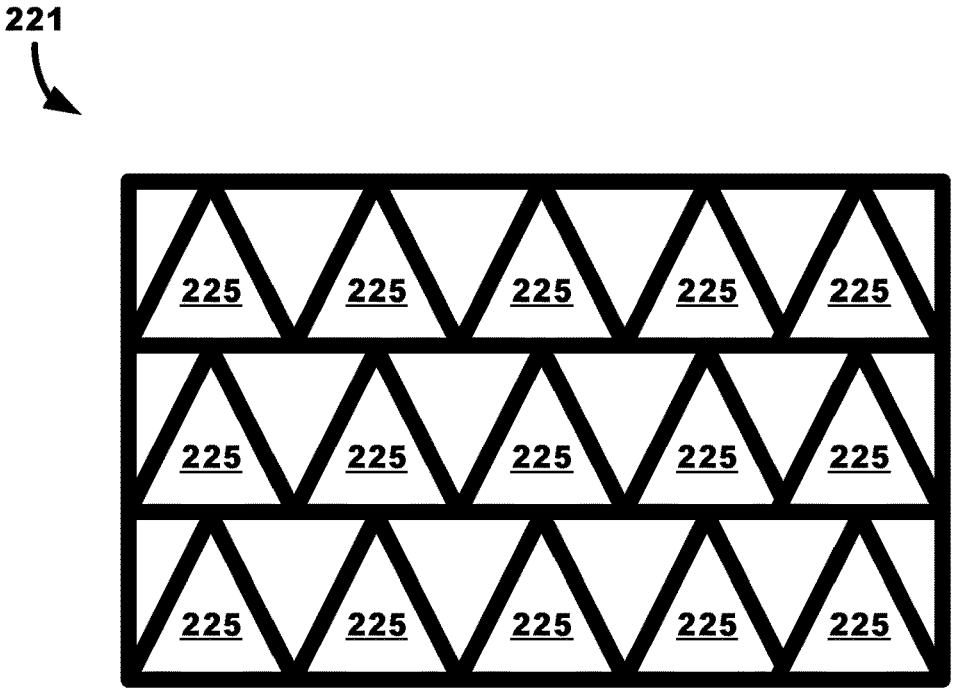
Figure 8:
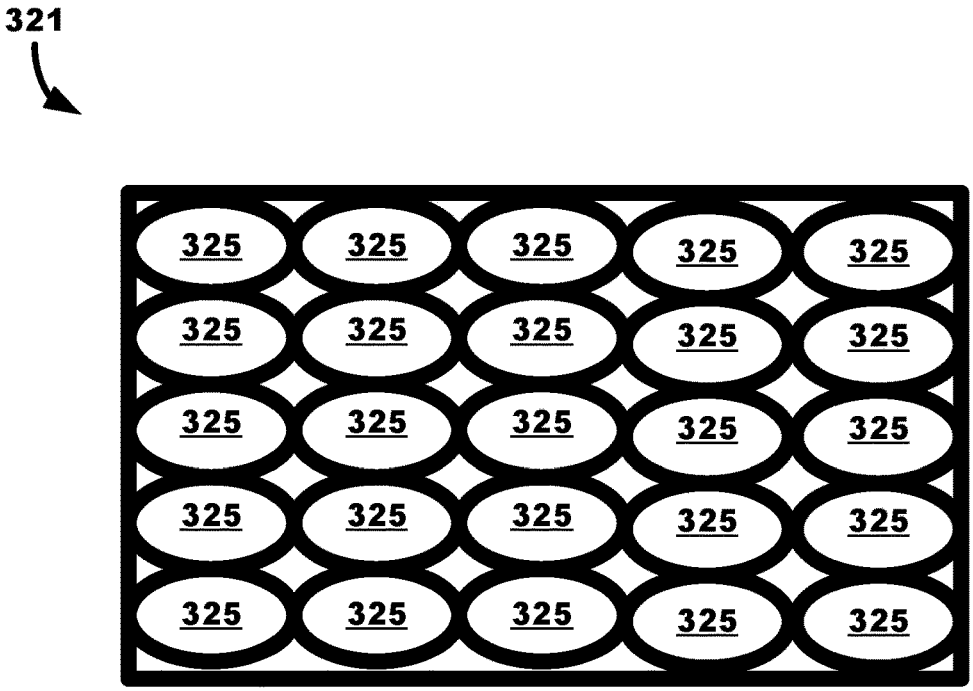

As illustrated in the illustrated example embodiments of FIGS. 5 and 5, the top wall 21, 221 comprises one or more openings 25, 225 having a polygonal geometric cross-section. Embodiments, however, are not limited thereto, and thus, this disclosure contemplates the one or more openings having any suitable non-polygonal geometric cross-section that falls within the spirit and scope of the principles of this disclosure. For example, as illustrated in the illustrated example embodiments of FIGS. 6 and 8, the top wall 121, 321 comprises one or more openings 125, 325 having a substantially circular or elliptical geometric cross-section. In accordance with one or more embodiments set forth, shown, and described herein, the one or more openings 25, 125, 225, 325 may have any suitable geometric cross-section that falls within the spirit and scope of the principles of this disclosure. In particular, the one or more openings 25, 125, 225, 325 may have any suitable geometric cross-section that optimizes the impact performance of the example vehicle occupant protection system 10, 400.

In accordance with one or more embodiments set forth, shown, and described herein, the one or more openings 25, 125, 225, 325 may have the same or uniform size (e.g., area). Embodiments, however, are not limited thereto, and thus, this disclosure contemplates the one or more openings having any suitable non-uniform sizes that falls within the spirit and scope of the principles of this disclosure. In particular, the one or more openings may have alternating, varying, or non-uniform sizes in a manner that optimizes the impact performance of the example vehicle occupant protection system 10.

Impact Attenuator Members

Figure 4:
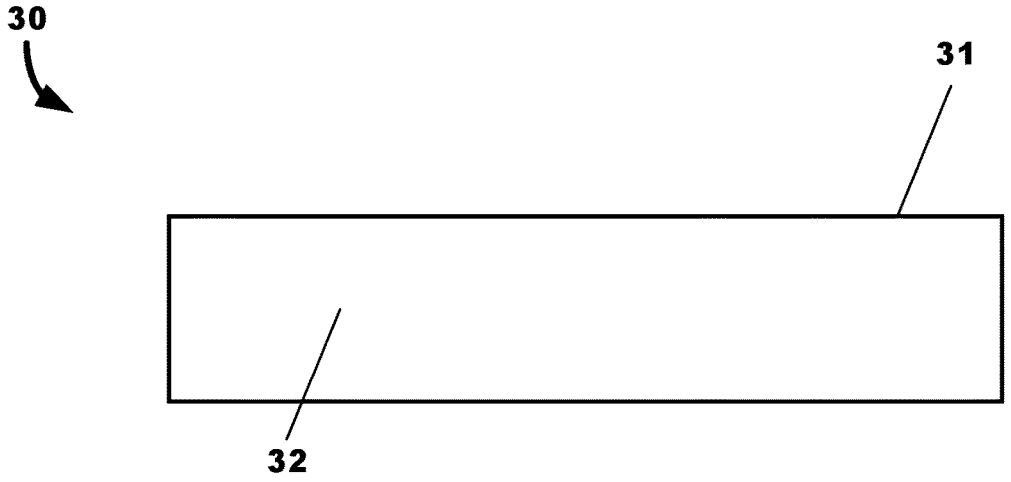
FIG. 4 illustrates a side sectional view of an example reusable impact attenuator member of the example reusable vehicle occupant protection system of FIG. 1.

As illustrated in FIG. 4, in accordance with one or more embodiments set forth, shown, and described herein, the one or more reusable impact attenuator members 30 comprise a reusable protective outer covering 31 that encloses a reusable protective filler material 32. The reusable protective filler material 32 may partially or completely fill the reusable protective outer covering 31.

In accordance with one or more embodiments set forth, shown, and described herein, the reusable protective outer covering 31 comprises a single- or multi-layered durable material exhibiting high impact resistance that lends itself for reuse over many operational cycles. Such a durable material may comprise, for example, an elastically-deformable polymer material or composite material. Such an elastically-deformable polymer material may comprise, for example, rubber. Alternatively, such an elastically-deformable polymer material may comprise, for example, a shape memory polymer material. Embodiments, however, are not limited thereto, and thus, this disclosure contemplates the reusable protective outer covering 31 being composed of any suitable material that falls within the spirit and scope of the principles of this disclosure. In particular, the reusable protective outer covering 31 may be composed of any material that optimizes the impact performance of the example vehicle occupant protection system 10.

In accordance with one or more embodiments set forth, shown, and described herein, the reusable protective filler material 32 is composed of a chemically inert, flowable, incompressible material or nearly incompressible material that lends itself for reuse over many operational cycles. Such a chemically inert, flowable, incompressible material or nearly incompressible material may comprise, for example, one or more of cornstarch, arrowroot powder, rice flour, sand, uncooked rice, glue, and polyurethane foam. Embodiments, however, are not limited thereto, and thus, this disclosure contemplates the reusable protective filler material 32 being composed of any suitable material that falls within the spirit and scope of the principles of this disclosure. In particular, the reusable protective filler material 32 may be composed of any material that optimizes the impact performance of the example vehicle occupant protection system 10.

Figure 2:
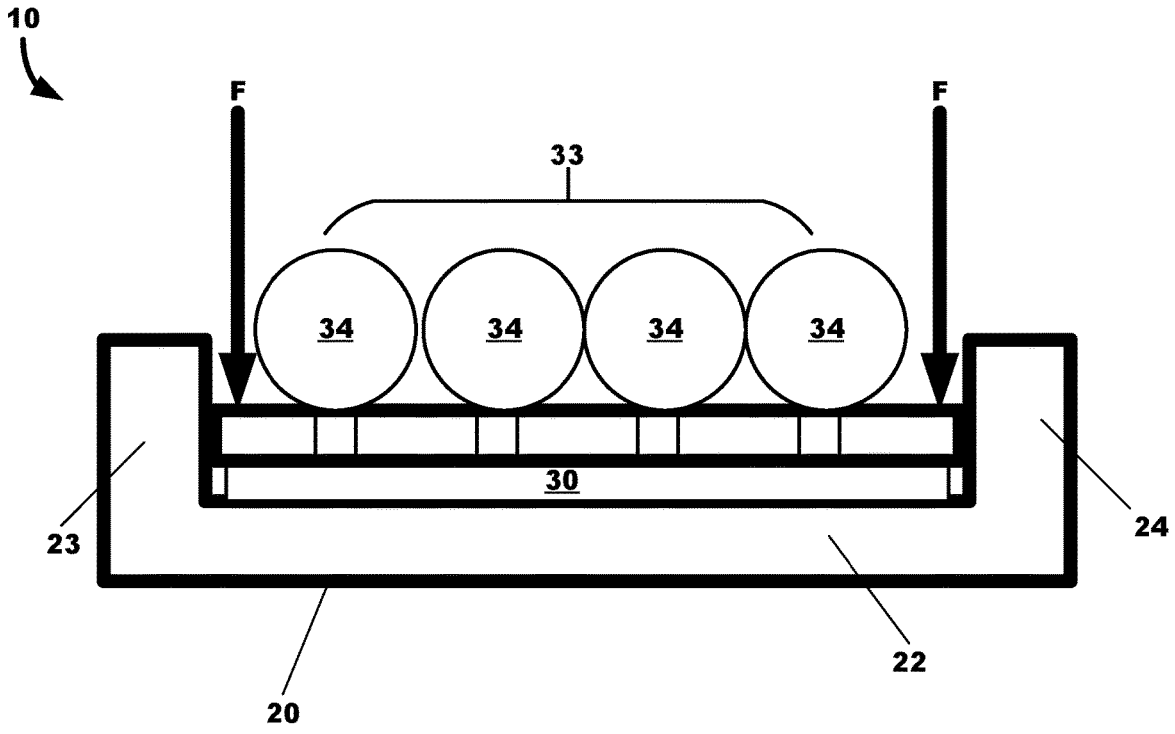
FIG. 2 illustrates a side sectional view of the example reusable vehicle occupant protection system of FIG. 1 in a deployed operating state.

In accordance with the illustrated embodiment of FIGS. 1 and 2, in response to receipt of the compressive force F by the moveable top wall 21, the one or more reusable impact attenuator members 30 are caused to move from a storage operating state (FIG. 1) to a deployed operating state (FIG. 2). Such movement may be in a direction opposite to the direction of the compressive force F.

In accordance with the illustrated embodiment of FIGS. 9 and 10, in response to receipt of the compressive force F by the moveable bottom wall 422, the one or more reusable impact attenuator members 430 are caused to move from a storage operating state (FIG. 9) to a deployed operating state (FIG. 10). Such movement may be in a direction opposite to the direction of the compressive force F.

In the storage operating state, the one or more reusable impact attenuator members 30, 430 have a first structural configuration/shape. In the deployed operating state, the one or more reusable impact attenuator members 30 have a second structural configuration/cross-section that is different than the first structural configuration/cross-section. Moreover, in the deployed operating state, the one or more reusable impact attenuator members 30, 430 are structurally deformed in a manner that extrudes at least a portion of the one or more reusable impact attenuator members 30, 430 through the one or more openings 25, 125, 225, 325 to form a cluster or array 33, 433 of impact bubbles 34, 434 which serve to cushion a vehicle occupant against the impact force to the vehicle. In accordance with one or more embodiments set forth, shown, and described herein, the size of the impact bubbles 34, 434 in the array 33, 433 may correspond to the magnitude of the compressive force F. In particular, the shape and/or size of the impact bubbles 34, 434 in the array 33, 433 is structurally adaptive or otherwise conforms to the compressive force F.

in accordance with one or more embodiments, each impact bubble 34, 434 in the array 33, 433 has a generally regular cross-section. Embodiments, however, are not limited thereto, and thus, this disclosure contemplates the impact bubbles 34, 434 having irregular cross-sections in a manner that falls within the spirit and scope of the principles of this disclosure. In particular, the impact bubbles 34, 434 may have any cross-section that optimizes the impact performance of the example vehicle occupant protection system 10, 400.

The compressive force F maintains formation of the array 33, 433 until the disengagement of the moveable top wall 21 or the moveable bottom wall 422 from the reusable impact attenuator members 30, 430. Meaning, release of the compressive force F by the moveable top wall 21 or the moveable bottom wall 422 causes the impact bubbles 34, 434 to retract through the one or more openings 25, 425, thereby returning the one or more reusable impact attenuator members 30, 430 to the storage state and the first structural configuration/cross-section.

Figure 11:
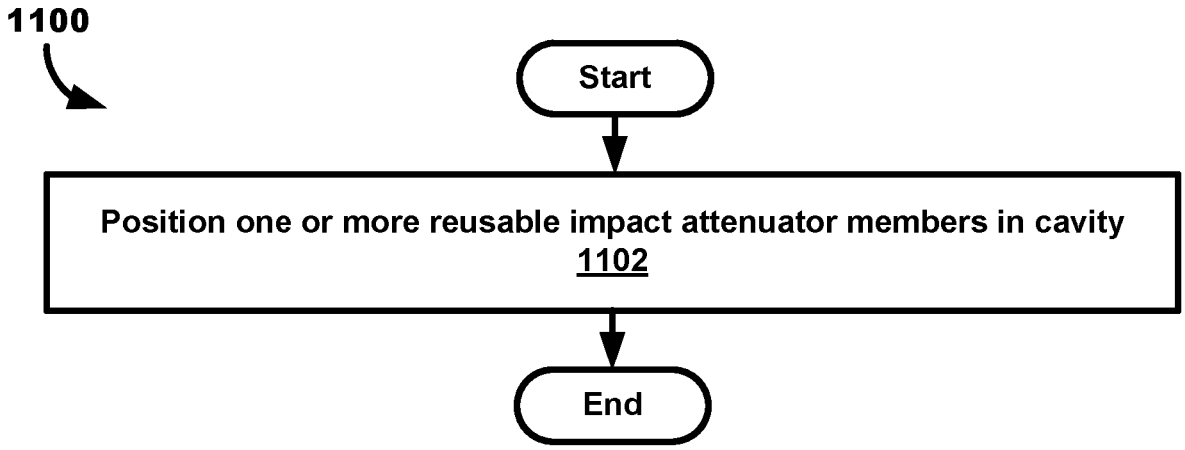
FIGS. 11 through 13 respectively illustrate a flowchart of an example method, in accordance with one or more embodiments set forth, shown, and described herein.
Figure 12:
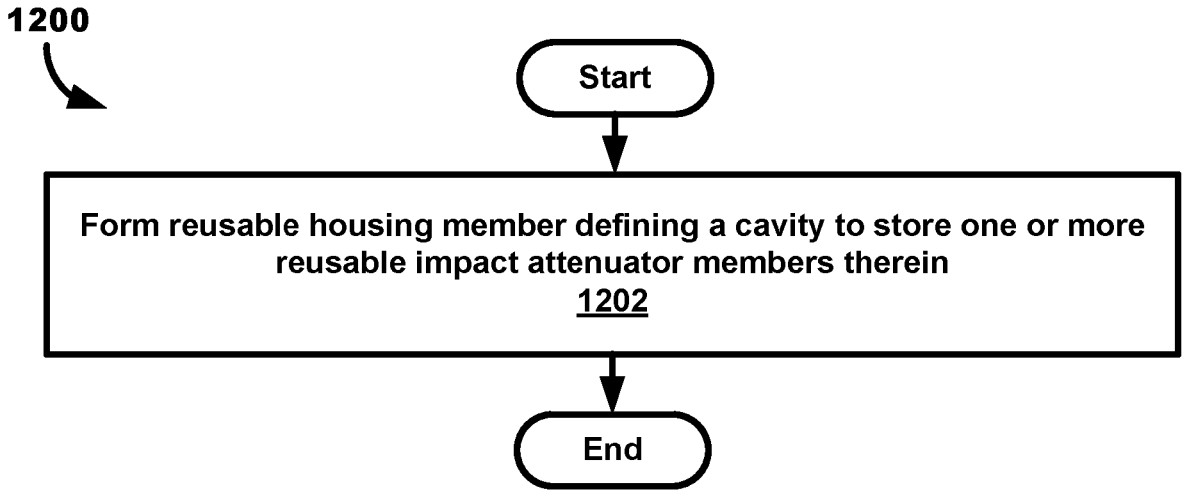
Figure 13:
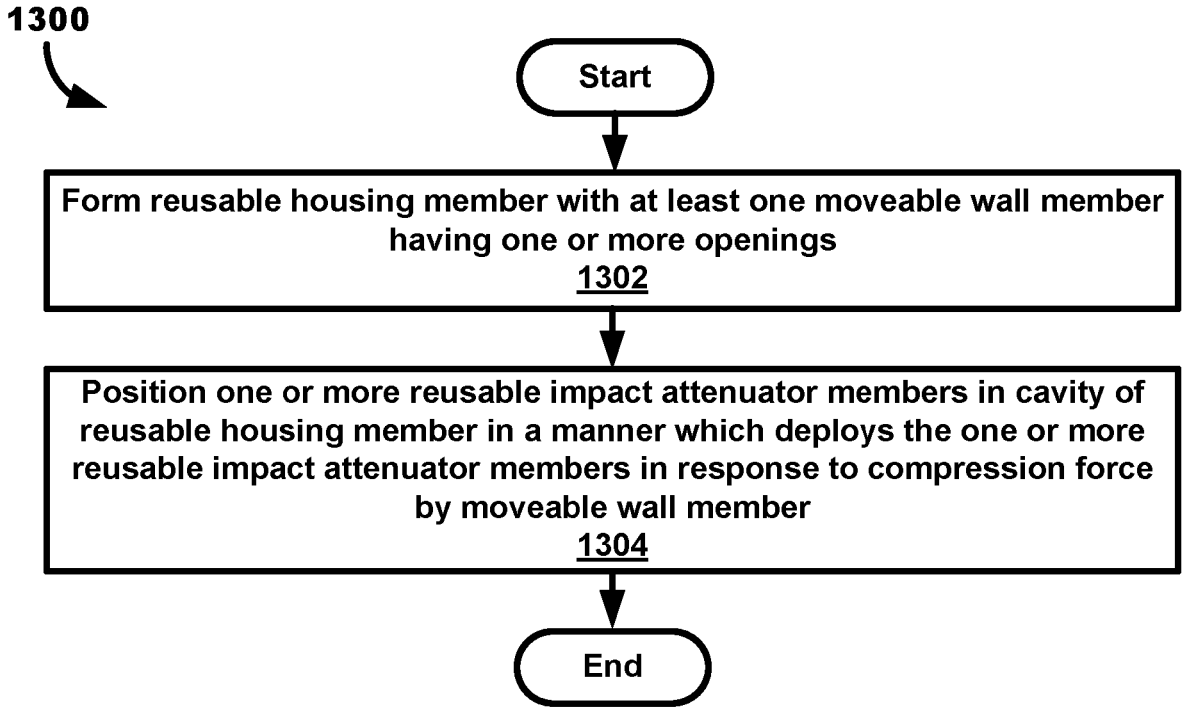

The illustrated examples of FIGS. 11 through 13 set forth example methods 1100, 1200, and 1300.

In the illustrated example embodiment of FIG. 11, illustrated process block 1102 includes positioning one or more reusable impact attenuator members in a cavity of a reusable housing member having at least one moveable wall having one or more openings, the one or more reusable impact attenuator members being moveable from a storage operating state to a deployed operating state in response to receipt of a compressive force by the at least one moveable wall that causes extrusion of at least a portion of the one or more reusable impact attenuator members through the one or more openings to form an array of impact bubbles which cushions a vehicle occupant against an impact force to the vehicle.

In accordance with illustrated process block 1102, the impact bubbles are caused to retract through the one or more openings in response to release of the compressive force by the at least one moveable wall.

In accordance with illustrated process block 1102, in the storage operating state, the one or more reusable impact attenuator members have a first structural configuration.

In accordance with illustrated process block 1102, in the deployed state, the one or more reusable impact attenuator members have a second structural configuration that is different than the first structural configuration.

In accordance with illustrated process block 1102, the one or more reusable impact attenuator members return to the first structural configuration in response to release of the compressive force by the at least one moveable wall.

The method 1100 can terminate or end after execution of illustrated process block 1102.

In the illustrated example embodiment of FIG. 12, illustrated process block 1202 includes forming a reusable housing member having a cavity to store one or more reusable impact attenuator members, reusable housing member having at least one moveable wall with one or more openings, the at least one moveable wall being moveable in response to receipt of an impact force to the vehicle, from an initial, inactive position to an active position which applies a compressive force to the one or more impact attenuator members, such compressive force causing extrusion of at least a portion of the one or more reusable impact attenuator members through the one or more openings to form an array of impact bubbles which cushions a vehicle occupant against the impact force.

In accordance with illustrated process block 1202, the one or more openings have the same geometric cross-section.

In accordance with illustrated process block 1202, the one or more openings have different geometric cross-sections.

In accordance with illustrated process block 1202, the one or more openings have the same geometric cross-section.

In accordance with illustrated process block 1202, the one or more openings have different geometric cross-sections.

The method 1200 can terminate or end after execution of illustrated process block 1202.

In the illustrated example embodiment of FIG. 13, illustrated process block 1302 includes forming a reusable housing member with at least one moveable wall having one or more openings.

In accordance with illustrated process block 1302, the one or more openings have the same geometric cross-section.

In accordance with illustrated process block 1302, the one or more openings have different geometric cross-sections.

In accordance with illustrated process block 1302, the one or more openings have the same geometric cross-section.

In accordance with illustrated process block 1302, the one or more openings have different geometric cross-sections.

The method 1300 may then proceed to illustrated process block 1304, which includes positioning one or more reusable impact attenuator members in a cavity of the reusable housing member, the one or more reusable impact attenuator members being moveable from a storage operating state to a deployed operating state in response to receipt of a compressive force by the at least one moveable wall that causes extrusion of at least a portion of the one or more reusable impact attenuator members through the one or more openings to form an array of impact bubbles which cushions a vehicle occupant against an impact force to the vehicle.

In accordance with illustrated process block 1304, the impact bubbles are caused to retract through the one or more openings in response to release of the compressive force by the at least one moveable wall.

In accordance with illustrated process block 1304, in the storage operating state, the one or more reusable impact attenuator members have a first structural configuration.

In accordance with illustrated process block 1304, in the deployed state, the one or more reusable impact attenuator members have a second structural configuration that is different than the first structural configuration.

In accordance with illustrated process block 1304, the one or more reusable impact attenuator members return to the first structural configuration in response to release of the compressive force by the at least one moveable wall.

The method 1300 can terminate or end after execution of illustrated process block 1304.

The terms "coupled," "attached," or "connected" may be used herein to refer to any type of relationship, direct or indirect, between the components in question, and may apply to electrical, mechanical, fluid, optical, electromagnetic, electro-mechanical or other connections. Additionally, the terms "first," "second," etc. are used herein only to facilitate discussion, and carry no particular temporal or chronological significance unless otherwise indicated. The terms "cause" or "causing" means to make, force, compel, direct, command, instruct, and/or enable an event or action to occur or at least be in a state where such event or action may occur, either in a direct or indirect manner.

Those skilled in the art will appreciate from the foregoing description that the broad techniques of the exemplary embodiments may be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A reusable vehicle occupant protection system, comprising:

a reusable housing member having at least one moveable wall having one or more openings; and one or more reusable impact attenuator members, disposed in a cavity of the reusable housing member, that are moveable from a storage operating state to a deployed operating state in response to receipt of a compressive force by the at least one moveable wall that extrudes at least a portion of the one or more reusable impact attenuator members through the one or more openings to form an array of impact bubbles which cushions a vehicle occupant against an impact force to a vehicle.

2. The reusable vehicle occupant protection system of claim 1, wherein the impact bubbles are caused to retract through the one or more openings in response to release of the compressive force by the at least one moveable wall.

3. The reusable vehicle occupant protection system of claim 1, wherein: in the storage operating state the one or more reusable impact attenuator members have a first structural configuration, and in the deployed operating state the one or more reusable impact attenuator members have a second structural configuration that is different than the first structural configuration.

4. The reusable vehicle occupant protection system of claim 3, wherein the one or more reusable impact attenuator members return to the first structural configuration in response to release of the compressive force by the at least one moveable wall.

5. The reusable vehicle occupant protection system of claim 1, wherein the one or more openings have the same geometric cross-section.

6. The reusable vehicle occupant protection system of claim 1, wherein the one or more openings have different geometric cross-sections.

7. The reusable vehicle occupant protection system of claim 1, wherein the one or more reusable impact attenuator members comprises a reusable protective outer covering that encloses a reusable protective filler material.

8. A reusable vehicle occupant protection system, comprising:

one or more reusable impact attenuator members that are moveable from a storage operating state to a deployed operating state in response to receipt of a compressive force by at least one moveable wall that causes extrusion of at least a portion of the one or more reusable impact attenuator members through one or more openings in the at least one moveable wall to form an array of impact bubbles which cushions a vehicle occupant against an impact force to a vehicle.

9. The reusable vehicle occupant protection system of claim 8, wherein the impact bubbles are caused to retract through the one or more openings in response to release of the compressive force by the at least one moveable wall.

10. The reusable vehicle occupant protection system of claim 8, wherein: in the storage operating state the one or more reusable impact attenuator members have a first structural configuration, and in the deployed operating state the one or more reusable impact attenuator members have a second structural configuration that is different than the first structural configuration.

11. The reusable vehicle occupant protection system of claim 10, wherein the one or more reusable impact attenuator members return to the first structural configuration in response to release of the compressive force by the at least one moveable wall.

12. A method, comprising:

positioning one or more reusable impact attenuator members in a cavity of a reusable housing member having at least one moveable wall having one or more openings, the one or more reusable impact attenuator members being moveable from a storage operating state to a deployed operating state in response to receipt of a compressive force by the at least one moveable wall that causes extrusion of at least a portion of the one or more reusable impact attenuator members through the one or more openings to form an array of impact bubbles which cushions a vehicle occupant against an impact force to a vehicle.

13. The method of claim 12, wherein the impact bubbles are caused to retract through the one or more openings in response to release of the compressive force by the at least one moveable wall.

14. The method of claim 12, wherein in the storage operating state, the one or more reusable impact attenuator members have a first structural configuration.

15. The method of claim 14, wherein in the deployed operating state, the one or more reusable impact attenuator members have a second structural configuration that is different than the first structural configuration.

16. The method of claim 15, wherein the one or more reusable impact attenuator members return to the first structural configuration in response to release of the compressive force by the at least one moveable wall.

17. The method of claim 12, wherein the one or more openings have the same geometric cross-section.

18. The method of claim 12, wherein the one or more openings have different geometric cross-sections.

19. The method of claim 12, wherein the one or more reusable impact attenuator members comprises a reusable protective outer covering.

20. The method of claim 19, wherein the one or more reusable impact attenuator members comprises a reusable protective filler material enclosed by the reusable protective outer covering.

* * * * *